United States Patent [19]

Bielka

[11] Patent Number: 4,914,930

[45] Date of Patent: Apr. 10, 1990

[54] JEWELED MESH FOR JEWELRY

[76] Inventor: Robert B. Bielka, 317 E. 75th St., Apt. #12, New York, N.Y. 10021

[21] Appl. No.: 217,659

[22] Filed: Jul. 12, 1988

[51] Int. Cl.[4] ..... A44C 17/02

[52] U.S. Cl. ..... 63/28; 63/26

[58] Field of Search ..... 63/28, 29.1, 30, 27, 63/26, 31; 29/160.6, 10

[56] References Cited

U.S. PATENT DOCUMENTS

| | | | |
|---|---|---|---|
| 1,544,619 | 7/1925 | Wakefield | 63/28 X |
| 2,056,705 | 10/1936 | Arpels . | |
| 2,510,774 | 6/1950 | Engel | 63/26 |

FOREIGN PATENT DOCUMENTS

| | | | |
|---|---|---|---|
| 832824 | 10/1938 | France | 63/28 |
| 833234 | 10/1938 | France | 63/28 |
| 2306652 | 5/1976 | France | 63/27 |
| 2414309 | 9/1979 | France | 63/28 |

*Primary Examiner*—Laurie K. Cranmer
*Attorney, Agent, or Firm*—Robert J. Hess

[57] ABSTRACT

A jeweled mesh having a plurality of stones mounted in hexagonal settings. The settings are linked together by a connector bridging diverging corners of three immediately adjacent settings. The settings have projections which extend through an opening in the connector so as to fit against an inner surface of the connector defining the opening. Retaining rings keep the connector in position.

16 Claims, 1 Drawing Sheet

FIG.1
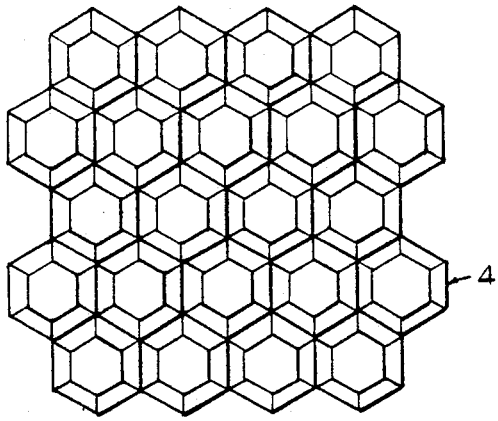
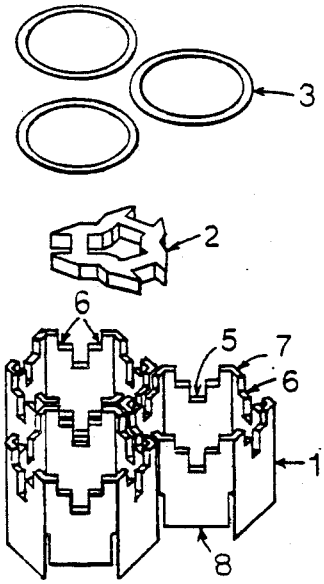
FIG.2
FIG.3
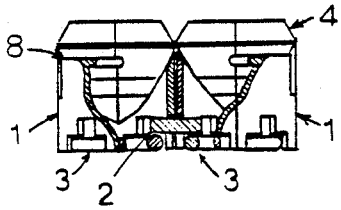
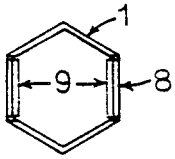
FIG.4

JEWELED MESH FOR JEWELRY

BACKGROUND OF THE INVENTION

The present invention relates generally to a jeweled mesh to be worn as jewelry. The jeweled mesh has hexagonal-shaped stones and settings. The corners of the settings are flexibly connected together by a linkage system.

Unlike stones with a circular cross-section, stones having a square cross-section that are arranged side by side do not leave spaces between stones and so have been used to form a jewelry mesh.

Since natural rough stones are rarely square, a lot of wasted stone material is generated when a square shape is cut out of the natural rough stone.

Further, the diagonal corners of stones with a square cross-section are adjacent to each other in a mesh. Since the mesh is flexible, these diagonal corners may come into contact with each other and fracture.

It is known to conceal a setting which mounts a precious stone by engaging opposite projections extending inward at the top of the setting into outwardly facing grooves cut in the stone. Generally, such settings are linked together in a mesh by spanning across adjacent sides with a connecting member. The settings for the stones with a square cross-section also have a square cross-section.

SUMMARY OF THE INVENTION

It is an object of the present invention to provide a jewelry mesh and linkage system that is an improvement over the prior art.

In keeping with this object, and others which will become apparent later on, one aspect of the invention resides, briefly stated, in a jeweled mesh comprising a plurality of precious stones each having a hexagonal cross-section, the stones being immediately adjacent to each other and having sides facing each other. The mesh also comprises settings mounting the stones and means for flexibly connecting the settings together.

Another aspect of the invention resides in an arrangement for forming a jewelry mesh comprising a connector with an inner surface defining a central opening and a plurality of immediately adjacent projections extending through and fitted against the inner surface of the connector so as to have play to provide flexibility to the arrangement. Means for retaining the projections in the openings are provided. Settings are formed with the projections and the settings may have a hexagonal cross-section.

It is a further object to provide an invisibly-set mesh link type jewelry item in any of various shapes, lengths, and widths as desired to form a continuous flexible band.

It is an additional object to reduce labor costs and the costs of precious stone material in the formation of a jewelry mesh over that required for jewelry meshes with stones having square cross-sections. This is effected by cutting a hexagon shape out of the generally larger, more commonly available and lower priced round stones. Because of the larger sizes of round stones available, the number of stones requires to form any jewelry item is reduced by at least ten percent. Further, the cost savings in acquiring round stones rather than square stones is about thirty percent due to lower prices.

When cutting natural rough stones, the hexagon shape results in a savings in material loss over that of a square shape when employed in a jewelry mesh in that hexagon shape more closely resembles the natural rough stone shape.

A further object is to facilitate the cutting and handling, as well as reduce the vulnerability to chipping when fully assembled, of a mesh type jewelry item that utilizes any of the more fragile precious stones such as emeralds. At present, ruby and sapphire are the only stones used in a jewelry mesh that are cut into squares. The hexagon shape of the present invention reduces the susceptibility of the corners to fracture due to the decrease in the sharpness of the angles of the corners of the hexagon (i.e. 120°) relative to those of the square (i.e. 90°).

Unlike meshes with hexagon shapes, meshes with squares have two diagonals of any given square directly opposing two diagonals of two other squares. If the jewelry item, which is entirely flexible, is bent slightly backwards and then slightly twisted, these opposing diagonal corners come into direct contact, which could easily result in their chipping, especially for the more fragile stones.

An additional object is to reduce the number of individual connectors necessary to link the settings together while mantaining both the close and precise position of each setting relative to each other with adequate flexibilty. Three converging corners of three immediately adjacent stones are linked together at their respective settings. This produces a savings in the number of individual connectors required by a factor of three as compared to linking all six sides of the hexagon individually.

Another object is to add rigidity to the connector to maintain a higher positional integrity. This is achieved by forming the connectors with an inner surface defining a central opening in which the inner surface conforms in shape to the outer surface of the projections fitted against this inner surface. The positional integrity is higher with such a connector than for connectors formed as plain rings applied at the same three converging corners or for individual connectors at adjacent sides. In addition, the connectors of the present invention enable the size of the pieces that can be accommodated to be increased by a factor of three as compared to individual connectors for each adjacent side.

The novel features which are considered as characeristic for the invention are set forth in particular in the appended claims. The invention itself, however, both as to its construction and its method of operation, together with additional objects and advantages thereof, will be best understood from the following description of the specific embodiments when read in connection with the accompanying drawings.

BRIEF DESCRIPTION OF THE DRAWINGS

FIG. 1 is a top view of an assembled jewelry mesh in accordance with the present invention.

FIG. 2 is an exploded bottom perspective view of a single linkage system (i.e. three settings, one connector and three retaining rings) for forming a jewelry mesh in accordance with the present invention.

FIG. 3 is a partially broken elevation side view of the single linkage system of FIG. 2, but with the addition of stones mounted in position.

FIG. 4 is a top view of the setting in accordance with the present invention.

DETAILED DESCRIPTION OF THE PREFERRED EMBODIMENTS

Referring now to the drawings, FIG. 1 shows a pattern of hexagonally cut stones 4 forming a jewelry mesh. Settings 1 mount the stones 4, but are concealed and so are not visible in FIG. 1. The whole jewelry mesh is flexible so that it can be worn as jewelry. Of course, the pattern of hexagonal groupings shown in FIG. 1 can be expanded by additional hexagonally cut stones to provide any size width or length.

Settings 1 are made from a section of hexagonally shaped tubing that is notched on each of the six sides of one end with two steps (double steps). The outermost level of steps forms the six corners 7 and shoulders 6. The innermost level of steps form the slots 5 that receive the connectors 2. At the other end of the tubing, two tabs 8 are formed by vertically cutting the tubing to define the sides of the tabs 8.

The stones 4 are secured in their settings 1 by the two tabs 8 on opposite sides of setting 1. These tabs 8 have a projection or bar 9 extending inward at their top end and may be larger than the other four walls of the setting 1. Each stone 4 has grooves into which these projections or bars 9 are engagable.

In order to releasably lock the stones 4 into the settings 1, the tabs 8, which are ductile, are bent away from each other outward to receive the stone 4. The tabs 8 are then bent back towards their original position so that the projections or bars 9 engage the grooves in the stone 4. In this manner, the stones are mounted in the settings so as to wholly conceal the settings 1 beneath the stones 4 as viewed in FIG. 1 for a jeweled mesh lying in a flat plane.

One connector 2 links three settings 1 at the convergence of their corners. Each setting 1 has room for three connectors 2. After the connector 2 has been positioned into two innermost notches or slots 5 of each of the three settings 2 (i.e., moving the connector 2 straight down from the position shown in FIG. 2), the retaining rings 3 are force fit into the setting 1 inside the six corners 7 so as to rest on the shoulders 6 (i.e. moving the retaining rings 3 straight down from the position shown in FIG. 2). The settings should have some play between them to provide flexibility to the arrangement. A clearance of 1/10 mm between settings is sufficient.

The amount of play can be adjusted by compressing the connector tighter against the corners by means of pliers. To facilitate the placement of pliers, the connector 2 is provided with outwardly projecting pairs of guiding members. The nose of the pliers is guided in the space between the guiding members and the other nose is placed on the diametrically opposite outer surface of the connector and then the pliers are squeezed to compress the connector.

In order to disassemble, the retaining rings 3 are first removed and then the stone 4 is lifted away from the connector 2 and out of setting 1.

Since the linkage system provides flexibility, flexing forces will cause slight openings between the stones to appear in accordance with the direction and extent of such flexing forces. These flexing forces arise when the jeweled mesh is flexed when worn as jewelry or manipulated off a flat plane. The sides of the settings 1 will then become more or less slightly visible.

The mesh need not be made with all the same size hexagons or regular hexagons as shown in FIG. 1. Rather, hexagons having two sides longer then the others, for example could be employed with the same type of linkage system.

Stones that are various types and of shapes other than hexagonal may be mouned in the settings, by this or other means of mounting.

The entire linkage system may be formed from platinum to provide durabilty and strength.

It will be understood that each of the elements described above, or two or more together, may also find a useful application in other types of jeweled meshes for jewelry differing from the types described above.

While the invention has been illustrated and described as embodied in a jewelry mesh for jewelry, it is not intended to be limited to the details shown, since various modifications and structural changes may be made without departing in any way from the spirit of the present invention.

Without further analysis, the foregoing will so fully reveal the gist of the present invention that other can, by applying current knowledge, readily adapt it for the various applications without omitting features that, from the standpoint of prior art, fairly constitute essential characteristics of the generic or specific aspects of this invention.

What is claimed as new and desired to be protected by Letters Patent is set forth in the appended claims.

1. A jeweled mesh, comprising:

a plurality of stones each having a hexagonal cross-section, said stones being immediately adjacent to each other and having sides facing each other, each of said stones also having corners;

a plurality of settings respectively mounting said stones; and means for flexibly connecting said settings together and for preventing said corners of said stones from chipping against each other during flexible movements of said settings, said flexibly connecting and preventing means including a connector holding at least three of said settings against each other so that said sides of said stones remain facing each other.

2. The mesh as defined in claim 1; and further comprising:

means for releasably locking said stones and said settings together so that said settings are concealed from view, said releasably locking means including a plurality of interengaging extensions and grooves, said stones being formed with said grooves, said settings having walls formed with said extension, said walls being bendable outward for accomodating one of said stones into position between said walls and being bendable back inward towards said stone thereafter.

3. An arrangement for forming a jeweled mesh, the arrangement comprising:

a connector with an inner perimetrical surface and an outer perimetrical surface, said connector having a body between said inner and outer perimetrical surfaces, said inner perimetrical surface defining a through-going opening that is spaced away from said outer perimetrical surface; and a plurality of immediately adjacent projections extending through said opening and fit against said inner perimetrical surface, said projections being arranged relative to each other so as to have play therebetween and each having a side facing said inner perimetrical surface of said connector, all of said sides together forming an outer facing perimetrical surface when said immediately adjacent projections are in said opening, said inner perimetrical surface conforming in shape to said outer facing perimetrical surface so as to limit said play and still allow said settings to move relative to each other within said limit of said play and so as to maintain positional integrity of said projections in said opening and prevent twisting of said projections in said opening.

4. The arrangement as defined in claim 3, wherein said retaining members are formed as rings.

5. The arrangement defined in claim 3, wherein said connector has guide means for facilitating adjustment of said play, said guide means including pair of outwardly projecting members, said pairs of outwardly projecting members being formed to guide a nose of pliers therebetween for compressing said connector and thereby tighten said connector against said immediately adjacent projections.

6. The arrangement as defined in claim 3, and further comprising:

a plurality of double stepped surfaces, a first of said stepped surfaces accommodating said connector thereon, a second of said stepped surfaces accommodating a respective one of said retaining members thereon.

7. The arrangement as defined in claim 3; further comprising:

a plurality of stones immediately adjacent to each other and having sides facing each other; and said stone settings respectively mounting said stones, said stone settings being formed with said immediately adjacent projections respectively.

8. The arrangement as defined in claim 7, wherein said immediately adjacent projections include three immediately adjacent projections all within said opening.

9. The arrangement as defined in claim 7; and further comprising:

means for releasably locking said stones and said stone settings together so that said settings are concealed from view, said releasably locking means including a plurality of interengaging projections and grooves, said stones being formed with said grooves, said stone settings having walls formed with said projections, said walls being bendable outward for accommodating one of said stones into position between said walls and being bendable back inward towards said stone thereafter.

10. The arrangement as defined in claim 7, wherein said stone settings have a hexagonal cross-section.

11. The arrangement as defined in claim 7, wherein said stones have a hexagonal cross-section.

12. The arrangement as defined in claim 7, wherein said stones have a polygonal cross-section.

13. An arrangement for forming a jeweled mesh, comprising:

plurality of settings;

a plurality of immediately adjacent projections, each of said projections extending from a respective one of said settings;

means for flexibly connecting together said immediately adjacent projections, said flexibly connecting means including a connector having a body bounded between an inner perimetrical surface and an outer perimetrical surface, said inner perimetrical surface defining a through-going opening which is spaced away from said outer perimetrical surface, each of said immediately adjacent projections extending through said opening so as to have a side facing said inner perimetrical surface, all of said sides together forming an outer facing perimetrical surface when said immediately adjacent projections are in said opening; and means for retaining said immediately adjacent projections in said opening so that said settings have play relative to each other, said inner perimetrical surface conforming in shape to said outer facing perimetrical surface so as to limit said play and still allow said settings to move relative to each other within said limit of said play and so as to whereby maintain positional integrity of said immediately adjacent projections in said opening and to prevent twisting of said immediately adjacent projections in said opening, wherein said retaining means includes a plurality of retaining members each against a respective portion of said connector, said connector being arranged between said retaining members and said stone settings.

14. The mesh as defined in claim 13, wherein said retaining members are formed as rings.

15. The mesh as defined in claim 13, wherein said connector has guide means for facilitating adjustment of said play, said guide means including pairs of outwardly projecting members, said pairs being formed so that a nose of pliers is guidable therebetween for compressing said connector and thereby tighten said connector against said immediately adjacent projections.

16. The mesh as defined in claim 13, wherein said settings each have double stepped surfaces, a first of said stepped surfaces accommodating said connector thereon, a second of said stepped surfaces accommodating a respective one of said retaining members hereon.

* * * * *